US010308049B2

(12) United States Patent
Kosuge

(10) Patent No.: US 10,308,049 B2
(45) Date of Patent: Jun. 4, 2019

(54) CUTTING DEVICE AND PRINTING APPARATUS INCLUDING CUTTING DEVICE

(71) Applicant: Seiko Epson Corporation, Tokyo (JP)

(72) Inventor: Shinsaku Kosuge, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/463,898

(22) Filed: Mar. 20, 2017

(65) Prior Publication Data

US 2017/0274680 A1 Sep. 28, 2017

(30) Foreign Application Priority Data

Mar. 28, 2016 (JP) ..... 2016-064498

(51) Int. Cl.

| | |
|---|---|
| ***B26D 1/30*** | (2006.01) |
| ***B41J 11/70*** | (2006.01) |
| ***B26D 1/00*** | (2006.01) |
| ***B26D 1/08*** | (2006.01) |
| ***B26D 5/14*** | (2006.01) |

(52) U.S. Cl.

CPC ..... *B41J 11/703* (2013.01); *B26D 1/0006* (2013.01); *B26D 1/085* (2013.01); *B26D 1/305* (2013.01); *B26D 5/14* (2013.01); *B26D 2001/0066* (2013.01)

(58) Field of Classification Search

CPC ..... B41J 11/703; B26D 1/305; B26D 1/085; B26D 5/14; B26D 1/0006; B26D 2001/0066

See application file for complete search history.

(56) References Cited

U.S. PATENT DOCUMENTS

2001/0037712 A1* 11/2001 Furuhata ..... B26B 13/06 83/694

FOREIGN PATENT DOCUMENTS

JP 10-151279 A 6/1998

* cited by examiner

*Primary Examiner* — Henok D Legesse

(74) *Attorney, Agent, or Firm* — ALG Intellectual Property, LLC

(57) ABSTRACT

A cutting device of a scissors type includes a fixed edge, a movable edge, and a support shaft configured to support the fixed edge and the movable edge to be capable of mutually rotating. A movable edge main body of the movable edge including a cut-off edge is cut into, centering on the support shaft, a fixed edge main body of the fixed edge including a cut-off edge. The cutting device includes a receiving member provided along at least an edge front side of the fixed edge main body and an edge front side of the movable edge main body and a pressing section configured to press at least one of the fixed edge main body and the movable edge main body to tilt in the opposite direction of the receiving member to be received by the receiving member.

10 Claims, 14 Drawing Sheets

CUTTING DEVICE AND PRINTING APPARATUS INCLUDING CUTTING DEVICE

BACKGROUND

1. Technical Field

The present invention relates to a cutting device of a scissors type including a fixed edge, a movable edge, and a support shaft that supports the fixed edge and the movable edge to be capable of mutually rotating and a printing apparatus including the cutting device.

2. Related Art

As the cutting device of this type, there has been known scissors in which a movable edge formed in a substantial "L" shape and a fixed edge formed in a substantial "L" shape are coupled to be capable of mutually turning by a support shaft (see JP-A-10-151279 (Patent Literature 1)).

In the scissors, the movable edge is integrally formed by a blade section and a handle section extending to form a substantially right angle each other. Similarly, the fixed edge is integrally formed by a blade section and a handle section extending to form a substantially right angle each other. The support shaft is provided in mutual bent portions of the blade sections and the handle sections forming the substantially right angles. The handle section of the fixed edge is fixed to a chassis. The handle section of the movable edge is coupled to cutting operation means.

On the other hand, in the blade section of the movable edge and the blade section of the fixed edge, folded sections having a very small angle is formed to extend along cut-off edges of the blade sections. Functions of so-called "splitting (gutter)", "warping (bowing)", and "twisting (torsion)" can be imparted to both the blade sections by the folded sections.

In the scissors (the cutting device) in the past, in cutting, an edge tip of the movable edge and an edge tip of the fixed edge are continuously brought into contact with each other by the "warping (bowing)" and "twisting (torsion)" to make so-called sharpness satisfactory. On the other hand, a force for separating the movable edge and the fixed edge from each other is caused to act on the support shaft by the warping (bowing) and "twisting (torsion)". Therefore, caulking of the support shaft weakens over time and backlash occurs in the movable edge and the fixed edge. When backlash (slack) occurs in the support shaft, in cutting, the movable edge and the fixed edge easily separate from each other around the support shaft and the sharpness is deteriorated.

SUMMARY

An advantage of some aspects of the invention is to provide a cutting device that can maintain satisfactory sharpness for a long time even if slack occurs in a support shaft and a printing apparatus including the cutting device.

A cutting device of a scissors type according to an aspect of the invention includes a fixed edge, a movable edge, and a support shaft configured to support the fixed edge and the movable edge to be capable of mutually rotating. A movable edge main body of the movable edge including a cut-off edge is cut into, centering on the support shaft, a fixed edge main body of the fixed edge including a cut-off edge. The cutting device includes: a receiving member provided along at least an edge front side of the fixed edge main body and an edge front side of the movable edge main body; and a pressing section configured to press at least one of the fixed edge main body and the movable edge main body to tilt in an opposite direction of the receiving member to be received by the receiving member.

With this configuration, at least one of the fixed edge main body and the movable edge main body is pressed by the pressing section to tilt in the opposite direction of the receiving member to be received by the receiving member. Therefore, even if the support shaft slacks, it is possible to maintain a pressing function by the pressing section. That is, even if slack occurs in the support shaft, a contact state of the fixed edge main body and the movable edge main body is maintained. It is possible to maintain original satisfactory sharpness for a long time. Note that the pressing section more desirably exhibits the pressing function mainly when slack occurs in the support shaft and exhibits the pressing function after a cut-in motion is started.

In this case, it is preferable that the pressing section presses a base side in at least one of the fixed edge main body and the movable edge main body.

With this configuration, it is possible to effectively press at least one of the fixed edge main body and the movable edge main body with the pressing section having a relatively small shape.

It is preferable that the pressing section is protrudingly provided in the receiving member.

With this configuration, it is possible to configure the pressing section without applying machining to the fixed edge and the movable edge.

It is preferable that the receiving member is provided along the edge front side of the movable edge main body, and the pressing section presses the movable edge main body.

With this configuration, it is possible to effectively press the movable edge main body with a simple structure.

In this case, it is preferable that a supporting frame of a mechanism adjacent to the movable edge is provided on the edge front side of the movable edge main body, and the supporting frame functions as the receiving member as well.

With this configuration, it is possible to provide the pressing section with a simple structure and high space efficiency by using the supporting frame of the adjacent mechanism.

A cutting device of a scissors type according to another aspect of the invention includes a fixed edge, a movable edge, and a support shaft configured to support the fixed edge and the movable edge to be capable of mutually rotating. The movable edge includes a movable edge main body including a cut-off edge and an actuation lever section ranging to the movable edge main body and bending and extending to the fixed edge side in the portion of the support shaft. At least one of an edge part of the actuation lever section separated from the support shaft in an extending direction of the fixed edge and an overlapping part of the fixed edge overlapping the edge part is formed in a concave shape to form a gap between the edge part and the overlapping part.

Incidentally, in the cutting device of the scissors type in which the movable edge includes the movable edge main body and the actuation lever section bending and extending to the fixed edge side in the portion of the support shaft, when slack occurs in the support shaft, reaction due to contact of the fixed edge and the actuation lever section, in particular, reaction due to contact of the part separated from the support shaft to the fixed edge side acts in a direction in which the movable edge main body is separated from the fixed edge around the support shaft.

With this configuration, since the gap is formed between the edge part of the actuation lever section separated from the support shaft in the extending direction of the fixed edge and the overlapping part of the fixed edge overlapping the edge part, it is possible sufficiently suppress reaction due to contact of this portion. Consequently, even if slack occurs in the support shaft, it is possible to prevent the movable edge main body from easily separating from the fixed edge around the support shaft. Therefore, it is possible to maintain original satisfactory sharpness for a long time.

In this case, it is preferable that, in an edge back of the fixed edge, a splitting section is recessed along an edge tip, the overlapping part of the edge part and the overlapping part is formed in a concave shape, and the overlapping part is configured by a recessed section ranging to the splitting section.

With this configuration, in the fixed edge, the splitting section and the recessed section can be integrally machined. The recessed section can be easily formed. Since it is unnecessary to apply concave machining to the actuation lever section, the strength of the actuation lever section that transmits a cutting force to the movable edge main body is not spoiled.

On the other hand, it is preferable that the cutting device includes a contact point section interposed between an extended upper part present on extension of the edge tip of the movable edge across the support shaft and an extended overlapping part of the fixed edge overlapping the extended upper part in a shaft peripheral edge portion on an edge back side of the movable edge and configured to press the movable edge main body to tilt to the fixed edge side with the support shaft as a fulcrum.

With this configuration, since the movable edge main body is pressed to tilt to the fixed edge side with the support shaft as the fulcrum by the contact point section, even if slack occurs in the support shaft, it is possible to maintain a contact state of the movable edge main body with the fixed edge. Therefore, it is possible to maintain original satisfactory sharpness for a long time.

In this case, it is preferable that the contact point section is provided in the fixed edge and formed in an arcuate shape centering on the support shaft.

With this configuration, in a cutting motion of the movable edge main body into the fixed edge, it is possible to stably bring cut-off edges of the movable edge main body and the fixed edge into contact with each other.

In this case, it is preferable that the contact point section has an inclined surface inclining upward in a turning direction of the cutting-in movable edge.

With this configuration, when the movable edge cuts in, so-called "torsion (twisting)" occurs in the movable edge main body. Therefore, in the cutting-in motion, it is possible to more stably bring the cut-off edges into contact with each other.

A printing apparatus according to still another aspect of the invention includes: a printing section configured to perform printing on a printing tape; and the cutting device configured to cut off a printed portion of the printing tape.

With this configuration, in the cutting device, it is possible to maintain satisfactory sharpness for a longtime. Therefore, it is possible to improve durability and reliability of the cutting device as a whole.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments in which a cutting device and a printing apparatus including the cutting device according to the invention are applied to a cutter unit and a tape printing apparatus including the cutter unit are explained below with reference to the accompanying drawings. The tape printing apparatus performs printing on a printing tape and performs half cut and full cut on a printed portion of a printing tape with the cutter unit to create a tape piece (a label).

Tape Printing Apparatus

Figure 1:
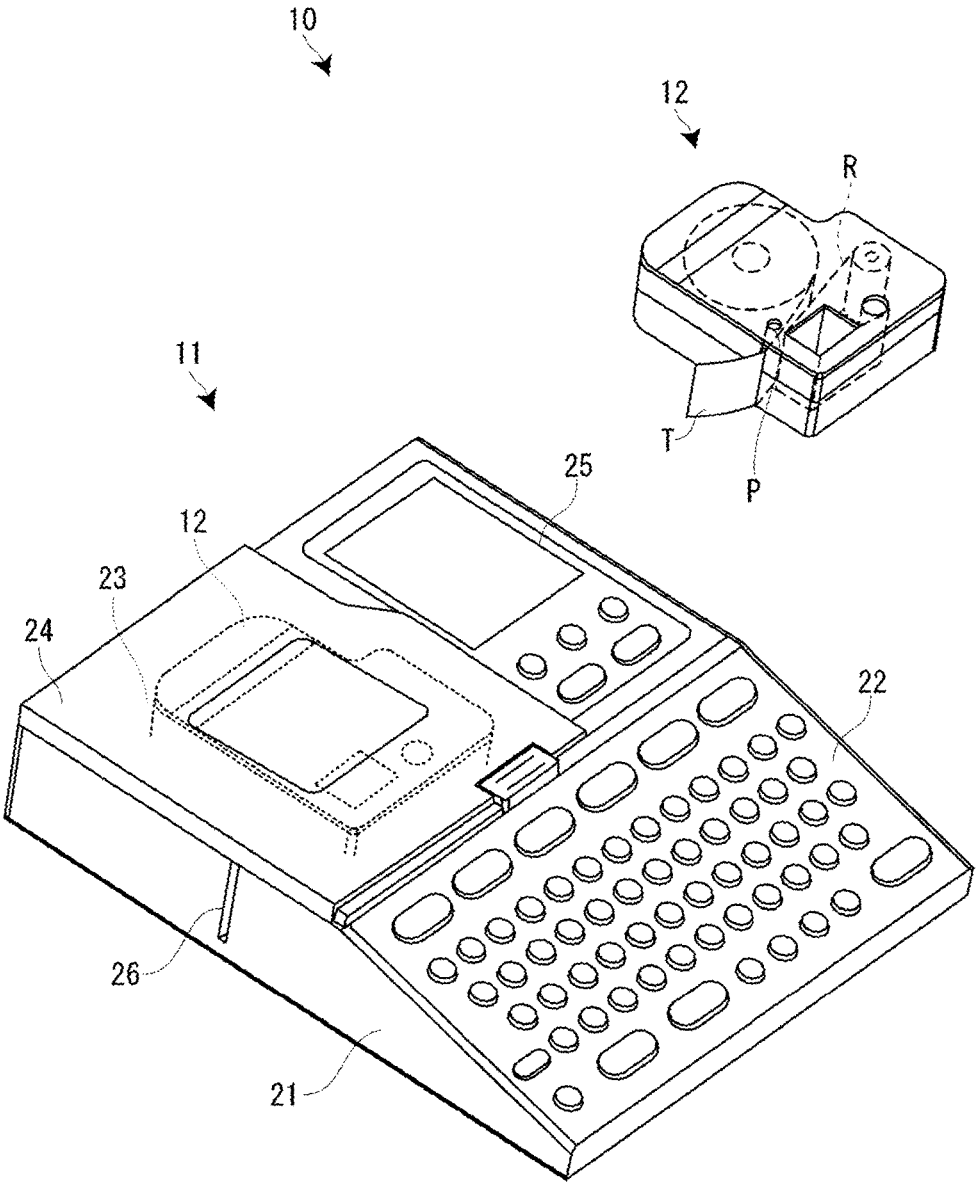
FIG. 1 is an exterior perspective view of a tape printing apparatus according to an embodiment of the invention.

FIG. 1 is an exterior perspective view of a tape printing apparatus. As shown in the figure, a tape printing apparatus 10 includes an apparatus main body 11 that performs printing on a printing tape T and a tape cartridge 12 that houses the printing tape T, an ink ribbon R, and a platen P and is detachably mounted on the apparatus main body 11. The printing tape T loaded in the tape cartridge 12 is configured by a tape attached with releasing paper (releasing tape). Note that the apparatus main body 11 is equivalent to the "printing apparatus" in the appended claims.

An outer shell of the apparatus main body 11 is formed by a substantially square apparatus case 21. A keyboard 22 is provided in a front half portion upper surface of the apparatus case 21. An opening/closing lid 24 for opening and closing a cartridge mounting section 23 (see FIG. 2), in which the tape cartridge 12 is mounted, is provided on a rear half portion upper left surface of the apparatus case 21. A display 25 is built in a rear half portion upper right surface. A slit-like tape discharge port 26 ranging to the cartridge mounting section 23 is formed in a left side portion of the apparatus case 21.

Figure 2:
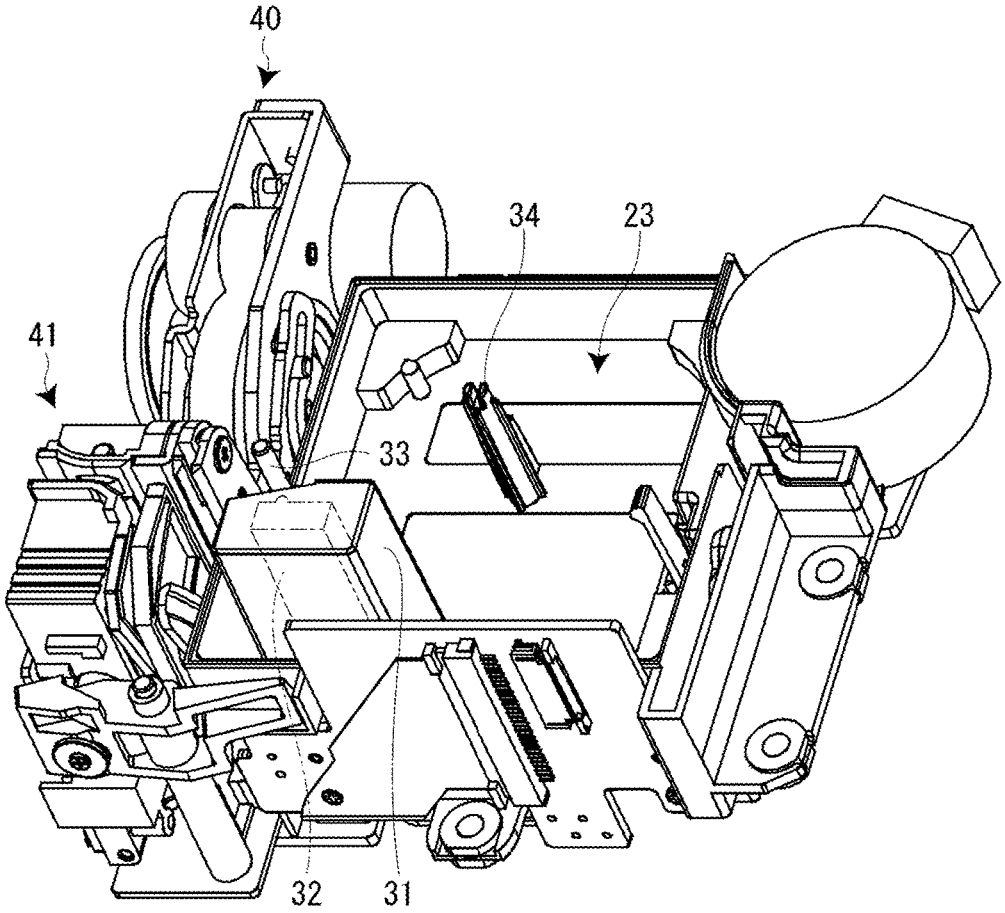
FIG. 2 is a perspective view showing the structure around a cartridge mounting section in the tape printing apparatus.

As shown in FIG. 2, a printing head 32 (a printing section) of a thermal type is disposed in a left front corner portion of the cartridge mounting section 23 to be covered by a head cover 31. A platen driving shaft 33 and a guide protrusion 34 are provided in the cartridge mounting section 23. Further, although not shown in the figure, a winding driving shaft for winding the ink ribbon R is provided in the cartridge mounting section 23.

On the other hand, a cutter unit 40 that performs half cut and full cut of the printing tape T and a discharge unit 41 that forcibly discharges, via the tape discharge port 26, a tape piece of the printing tape T cut off by the cutter unit 40 are disposed between the cartridge mounting section 23 and the tape discharge port 26. The cutter unit 40 includes a full cut section 40A that cuts off a printed portion (a tape piece) of the printing tape T and a half cut section 40B that carries out half cut on the printed portion. Note that the full cut section 40A is equivalent to the "cutting device" in the appended claims.

When the tape cartridge 12 is mounted on the cartridge mounting section 23, the platen P of the tape cartridge 12 engages with the platen driving shaft 33 and a core of the ink ribbon R engages with the winding driving shaft to be capable of transmitting power. Subsequently, when the opening/closing lid 24 is closed, the printing head 32 is pressed by the platen P to hold the printing tape T and the ink ribbon R. When a printing command is issued in this printing standby state, the platen driving shaft 33 and the winding driving shaft synchronously rotate. The printing tape T and the ink ribbon R are sent in parallel in the portion of the printing head 32. The printing head 32 is driven to execute printing on the printing tape T by thermal transfer.

When the printing proceeds, a printed portion of the printing tape T is separated from the ink ribbon R and sent into the cutter unit 40 and the discharge unit 41. The cutter unit 40 performs the half cut and the full cut on the printed portion of the printing tape T. The printed portion (the tape piece: the label) cut off by the cutter unit 40 is forcibly discharged from the tape discharge port 26 by the discharge unit 41.

The cutter unit 40 and the discharge unit 41 are explained with reference to FIGS. 2 and 3. As explained above, the cutter unit 40 and the discharge unit 41 are disposed in a space between the cartridge mounting section 23 and the tape discharge port 26. The cutter unit 40 includes the full cut section 40A and the half cut section 40B. The units perform operation on the printing tape T (the printed portion) in the order of the half cut by the half cut section 40B, the full cut by the full cut section 40A, and the tape discharge by the discharge unit 41.

The discharge unit 41 includes a discharge roller 45 (a nip roller) including a discharge driving roller 46 and a discharge driven roller 47 and holds and rotationally feeds (discharges) the printing tape T (the tape piece). In this case, a power source of the discharge unit 41 (the discharge driving roller 46) is common to the platen driving shaft 33 that feeds the printing tape T and the winding driving shaft that feeds the ink ribbon R. The operation for discharging the tape piece and the operation for feeding the printing tape T and the ink ribbon R are performed by clutch switch based on normal and reverse rotations of the power source.

Cutter Unit

Figure 4:
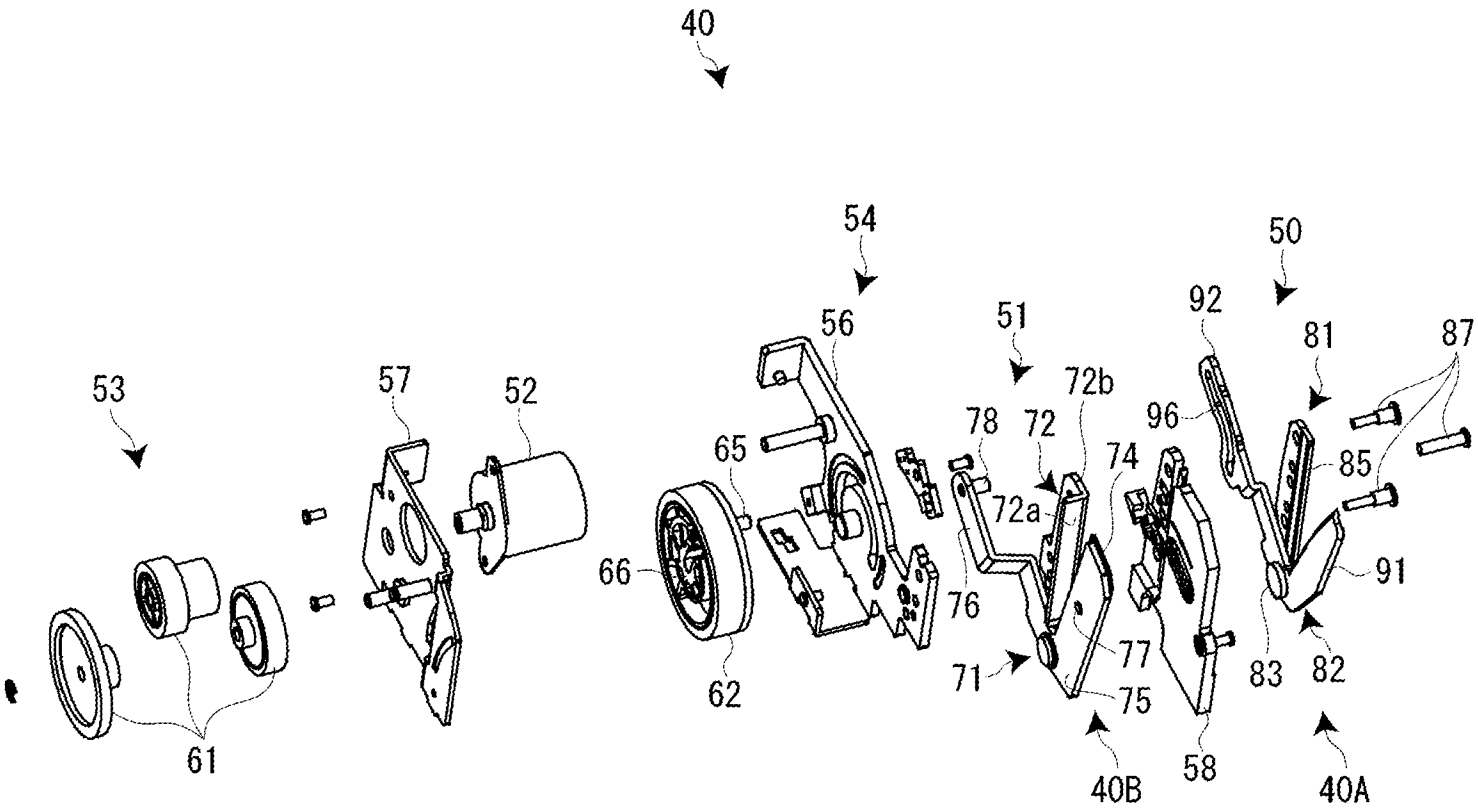
FIG. 4 is an exploded perspective view of the cutter unit.

As shown in FIGS. 2 and 4, the cutter unit 40 includes the full cut section 40A on the printing head 32 side and the half cut section 40B on the discharge unit 41 side. The full cut section 40A and the half cut section 40B share a cutter motor 52, a power transmission mechanism 53, and a cutter frame explained below. The full cut section 40A operates according to the normal rotation of the cut motor 52 and the half cut section 40B operates according to the reserve rotation of the cut motor 52.

Figure 3:
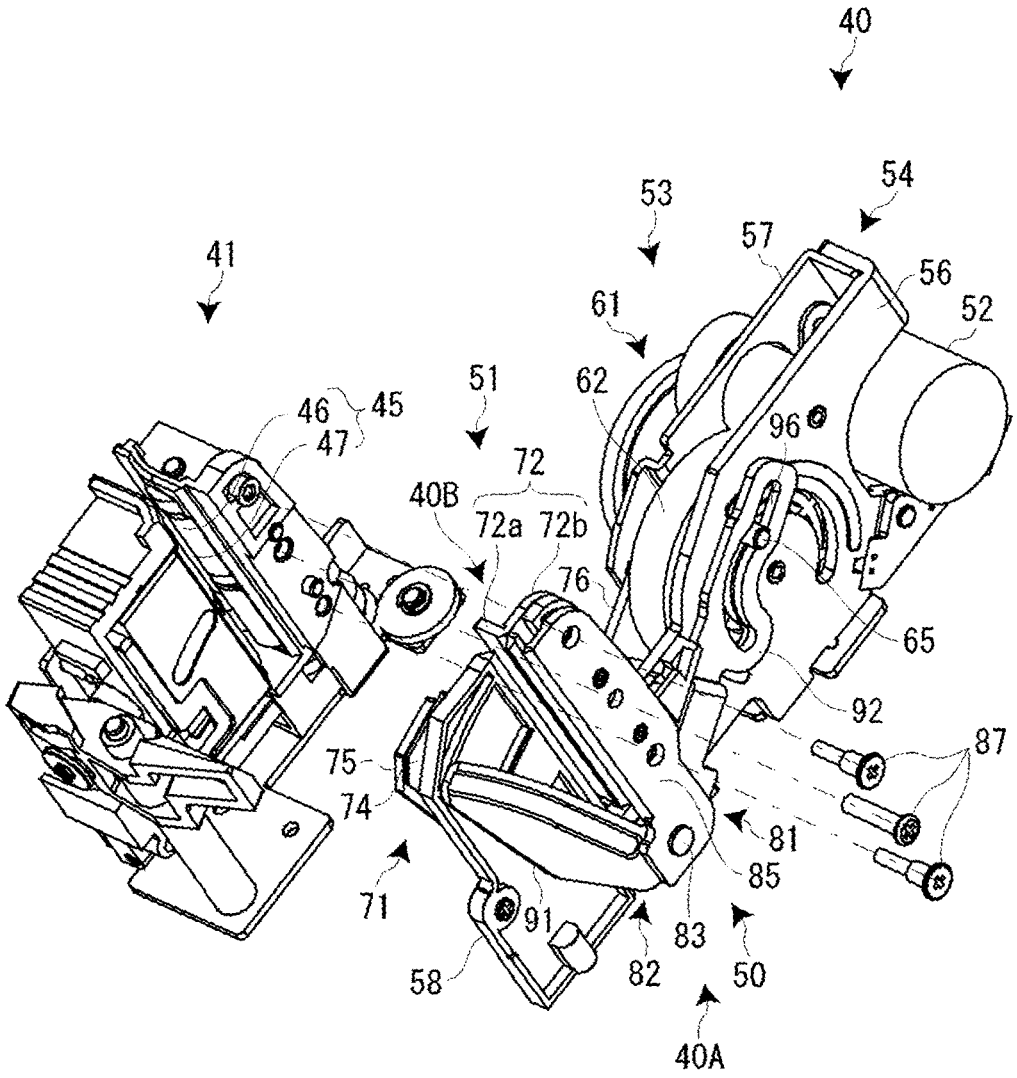
FIG. 3 is an exploded perspective view showing a cutter unit and a discharge unit.

As shown in FIGS. 3 and 4, the cutter unit 40 includes a full cutter 50 forming a main body of the full cut section 40A and a half cutter 51 forming a main body of the half cut section 40B. The cutter unit 40 includes a cutter motor 52 functioning as a power source of the full cutter 50 and the half cutter 51, a power transmission mechanism 53 that transmits power of the cutter motor 52 to the full cutter 50 and the half cutter 51, and a cutter frame 54 that supports these components.

The cutter frame 54 includes a main frame 56 made of sheet metal, a sub-frame 57 opposed to the main frame 56 via a gap, and a spacer frame 58 made of resin supported by the main frame 56. The main frame 56 and the sub-frame 57 support the cutter motor 52 and the power transmission mechanism 53. The spacer frame 58 is interposed between the full cutter 50 and the half cutter 51. The spacer frame 58, the full cutter 50, and the half cutter 51 are supported by an end portion of the main frame 56 in a jointly fastened state.

The cutter motor 52 is configured to be capable of rotating normally and reversely. Normal rotation power of the cutter motor 52 is transmitted to the full cutter 50 and reverse rotation power of the cutter motor 52 is transmitted to the half cutter 51 via the power transmission mechanism 53. The power transmission mechanism 53 includes a reduction gear train 61 to which power is input from the cutter motor 52 and a crank disk 62 that outputs power to the full cutter 50 and the half cutter 51. The normal and revere rotation power of the cutter motor 52 is transmitted to the crank disk 62 via the reduction gear train 61.

The crank disk 62 and the full cutter 50 (a movable edge 82 explained below) and the half cutter 51 (a cutting edge 71 explained below) configure a so-called swing crank mechanism. A crank pin 65 that outputs rotation power to the full cutter 50 is provided on one surface of the crank disk 62. A guide groove 66 that outputs rotation power to the half cutter 51 is provided on the other surface. As explained in detail below, an input long hole 96 of the movable edge 82 in the full cutter 50 engages with the crank pin 65. An input pin 78 of the cutting edge 71 in the half cutter 51 engages with the guide groove 66.

In this case, in the input long hole 96, an effective hole portion that transmits power of the crank disk 62 and an ineffective hole portion that does not transmit the power are present. Similarly, in the guide groove 66, an effective groove portion that transmits the power of the crank disk 62 and an ineffective groove portion that does not transmit the power are present. When the cutter motor 52 normally rotates to actuate the full cutter 50, the crank pin 65 engages with the effective hole portion of the input long hole 96 and, on the other hand, the ineffective groove portion of the guide groove 66 engages with the input pin 78 to prevent the half cutter 51 from operating. When the cutter motor 52 reversely rotates to actuate the half cutter 51, the effective groove portion of the guide groove 66 engages with the input pin 78 and, on the other hand, the crank pin 65 engages with the ineffective hole portion of the input long hole 96 to prevent the full cutter 50 from operating.

As shown in FIGS. 3 and 4, the half cutter 51 includes a cutting edge 71 that cuts into the printing tape T according to a turning motion and an edge receiving member 72 that receives the cutting edge 71 cut into the printing tape T. The cutting edge 71 includes a thin plate-like blade 74 made of steel, a holder section 75 that holds the blade 74, and an arm section 76 bending and extending from the holder section 75.

The blade 74 is turnably attached to the holder section 75 by a turning pin 77. The blade 74 slightly turns as appropriate to be always in contact with the edge receiving member 72 in parallel. The holder section 75 and the arm section 76 are integrally formed. The arm section 76 extends in a crank shape to avoid the crank disk 62. An input pin 78 that engages with the guide groove 66 of the crank disk 62 is provided at an end portion of the arm section 76.

The edge receiving member 72 is integrally formed in an "L" shape in section by an edge receiving main body 72*a* that receives the blade 74 while keeping the printing tape T and an edge receiving fixed section 72*b* attached to the spacer frame 58. The cutting edge 71 receives the rotation of the crank disk 62 and turns around a fulcrum, whereby the blade 74 of the cutting edge 71 cuts in toward the edge receiving main body 72*a* and the half cut of the printing tape T is performed.

Full Cutter

Figure 5:
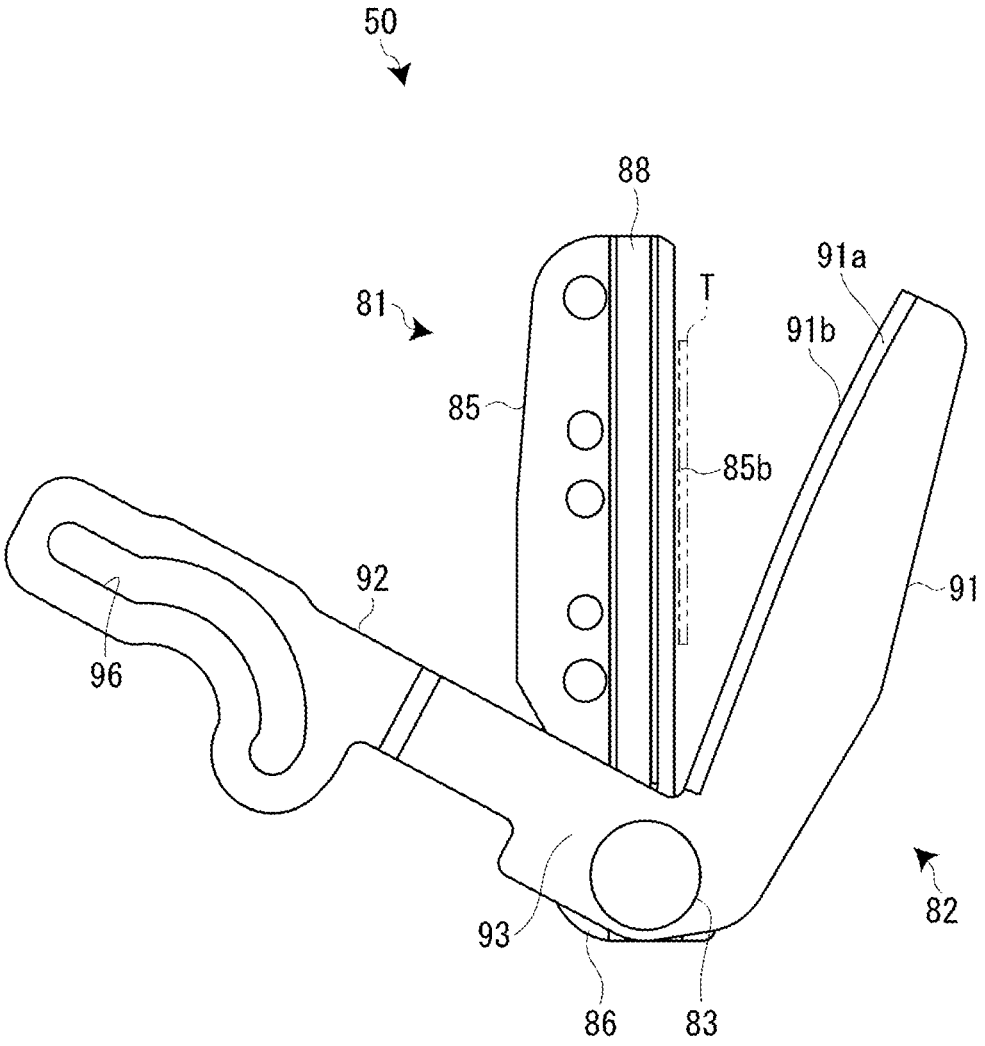
FIG. 5 is a plan view of a full cutter viewed from a movable edge side.
Figure 6:
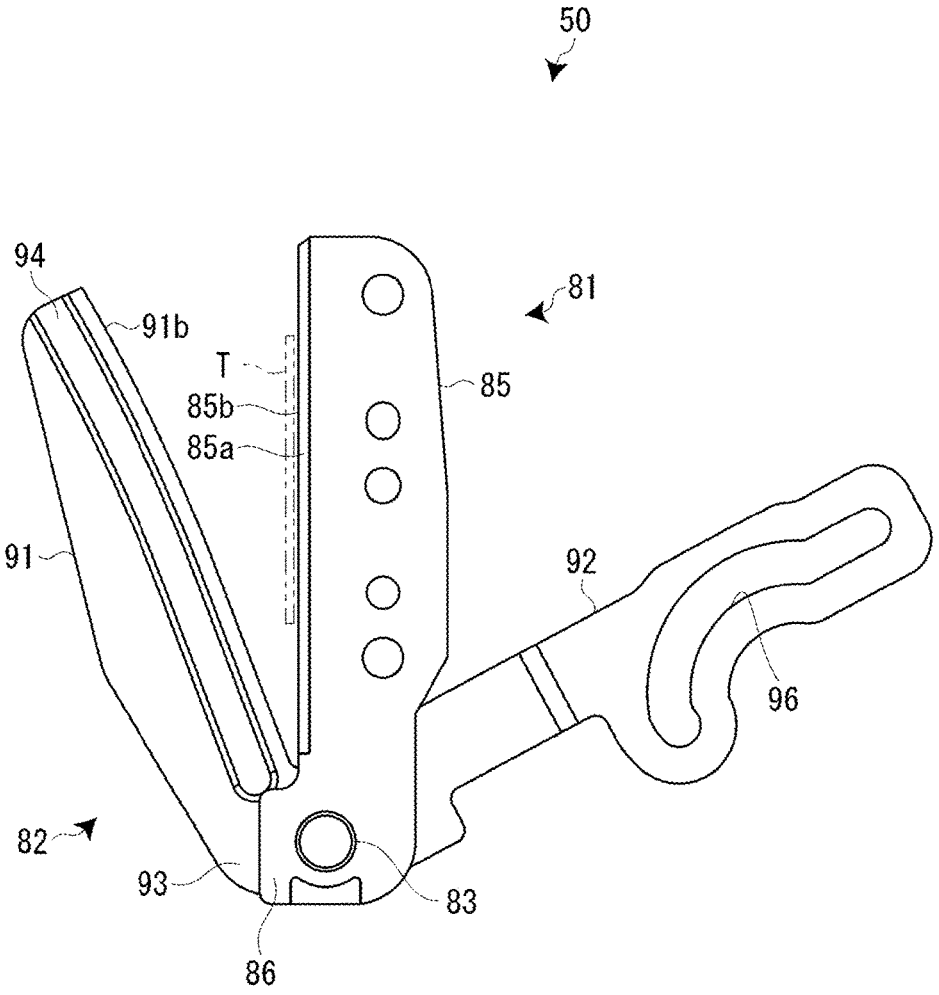
FIG. 6 is a plan view of the full cutter viewed from a fixed edge side.

As shown in FIGS. 4, 5, and 6, the full cutter 50 includes a fixed edge 81 fixed to the spacer frame 58, a movable edge 82 that performs a cutting-in motion with respect to the fixed edge 81, and a support shaft 83 (a caulking pin) that supports the fixed edge 81 and the movable edge 82 to be capable of mutually turning. That is, the full cutter 50 is configured by a cutter that performs a cutting motion in a scissors type.

The fixed edge 81 is integrally formed in a substantial "J" shape in plan view by a fixed edge main body 85 including a cut-off edge 85*a* and an axially supported section 86 on a proximal end side that ranges to the fixed edge main body 85 and through which the support shaft 83 is inserted. The fixed edge 81 is disposed such that an edge front faces the printing head 32 side and an edge back faces the half cutter 51 side. The fixed edge main body 85 extends upward and is fixed to the spacer frame 58 to be pressed by a plurality of stepped screws 87 (see FIG. 3).

The cut-off edge 85*a* is provided along an edge tip 85*b* (an edge line) on an edge front of the fixed edge main body 85. A splitting section 88 configured by a shallow groove is provided along the edge tip 85*b* on an edge back of the fixed edge main body 85. In the fixed edge main body 85, so-called "bowing (warping)" and "torsion (twisting)" are provided. The edge tip 85*b* of the fixed edge main body 85 and an edge tip 91*b* of a movable edge main body 91 explained below are continuously in point-contact from proximal end portions to distal end portions.

The movable edge 82 is integrally formed in a substantial "L" shape in plan view by a movable edge main body 91 including a cut-off edge 91*a* and an actuation lever section 92 ranging to the movable edge main body 91 and bending and extending to the fixed edge 81 side in the portion of the support shaft 83. The support shaft 83 is pierced through a bent section 93 on the movable edge main body 91 side of the actuation lever section 92. The movable edge 82 is turnably supported by the fixed edge 81 via the support shaft 83 in the bent section 93. The movable edge 82 (the movable edge main body 91) is disposed such that an edge front faces the half cutter 51 side and an edge back faces the printing head 32 side.

As in the fixed edge main body 85, the cut-off edge 91*a* is provided along the edge tip 91*b* (an edge line) on the edge front of the movable edge main body 91. A splitting section 94 configured by a shallow groove is provided along the edge tip 91*b*. The edge tip 91*b* of the movable edge main body 91 is configured by a so-called serrated edge bent a little. Consequently, it is possible to prevent the printing tape T from moving upward when being cut in and maintain an appropriate cut-in angle from the proximal end portion to the distal end portion. In the movable edge main body 91, so-called "bowing (warping)" and "torsion (twisting)" are also provided.

The actuation lever section 92 extends toward the crank disk 62. At an end portion of the actuation lever section 92, an input long hole 96 engaging in the crank pin 65 of the crank disk 62 is formed. The rotation of the crank disk 62 turns the actuation lever section 92 (the movable edge 82) via the input long hole 96. The actuation lever section 92 turns around the support shaft 83, whereby the movable edge main body 91 cuts into the fixed edge main body 85 and the full cut of the printing tape T is performed.

Incidentally, in the full cutter 50 of the scissors type in this embodiment, in some case, caulking of the support shaft 83 weakens over time and backlash (slack) occurs in the fixed edge 81 and the movable edge 82. In such a case, the fixed edge 81 and the movable edge 82 easily separate around the support shaft 83 and sharpness is deteriorated. In general manual scissors, the fixed edge 81 and the movable edge 82 can be brought into contact with each other according to power adjustment of a fingertip. However, in the motor-driven scissors (the full cutter 50) in this embodiment, it may be difficult to simply bring the fixed edge 81 and the movable edge 82 into contact with each other. A mechanism equivalent to the power adjustment is necessary.

First Embodiment

Figure 7:
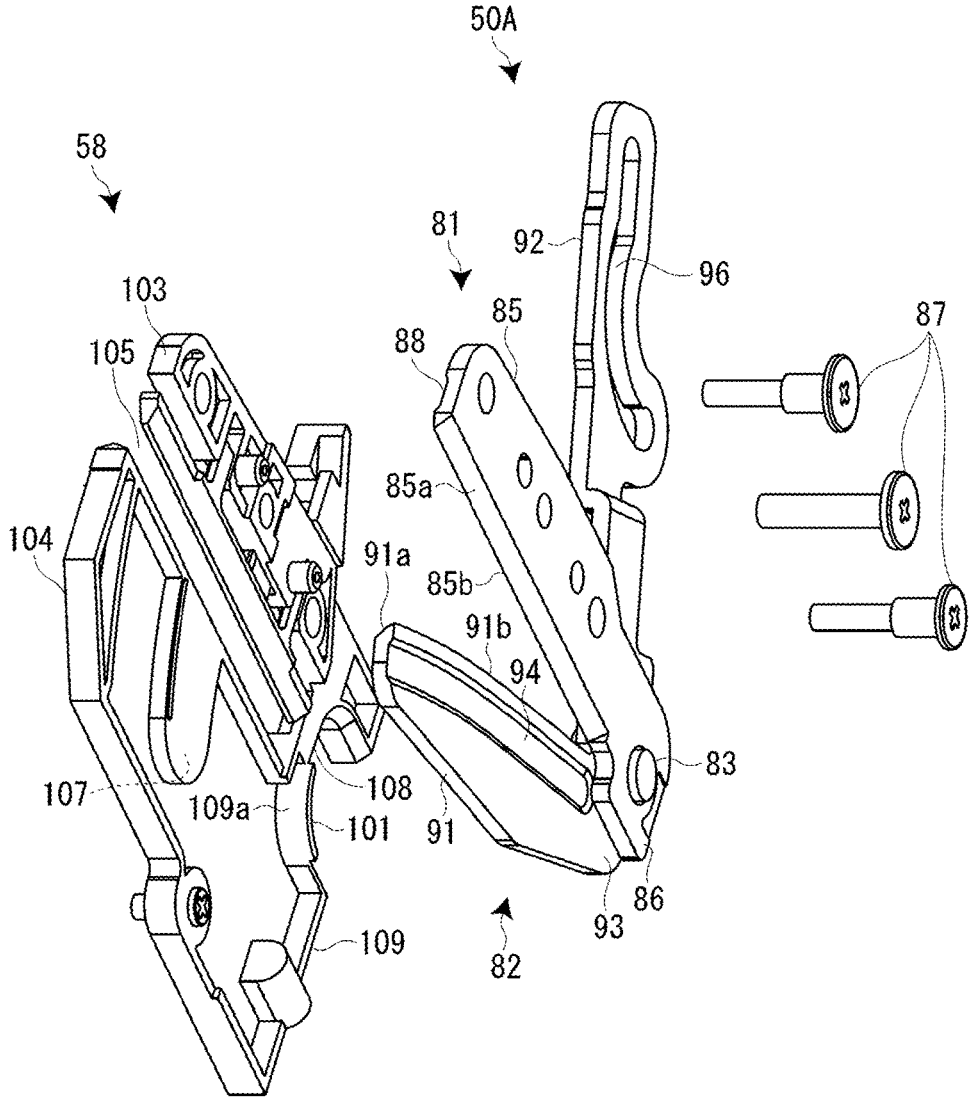
FIG. 7 is an exploded perspective view of a main part of the cutter unit according to the first embodiment.
Figure 8:
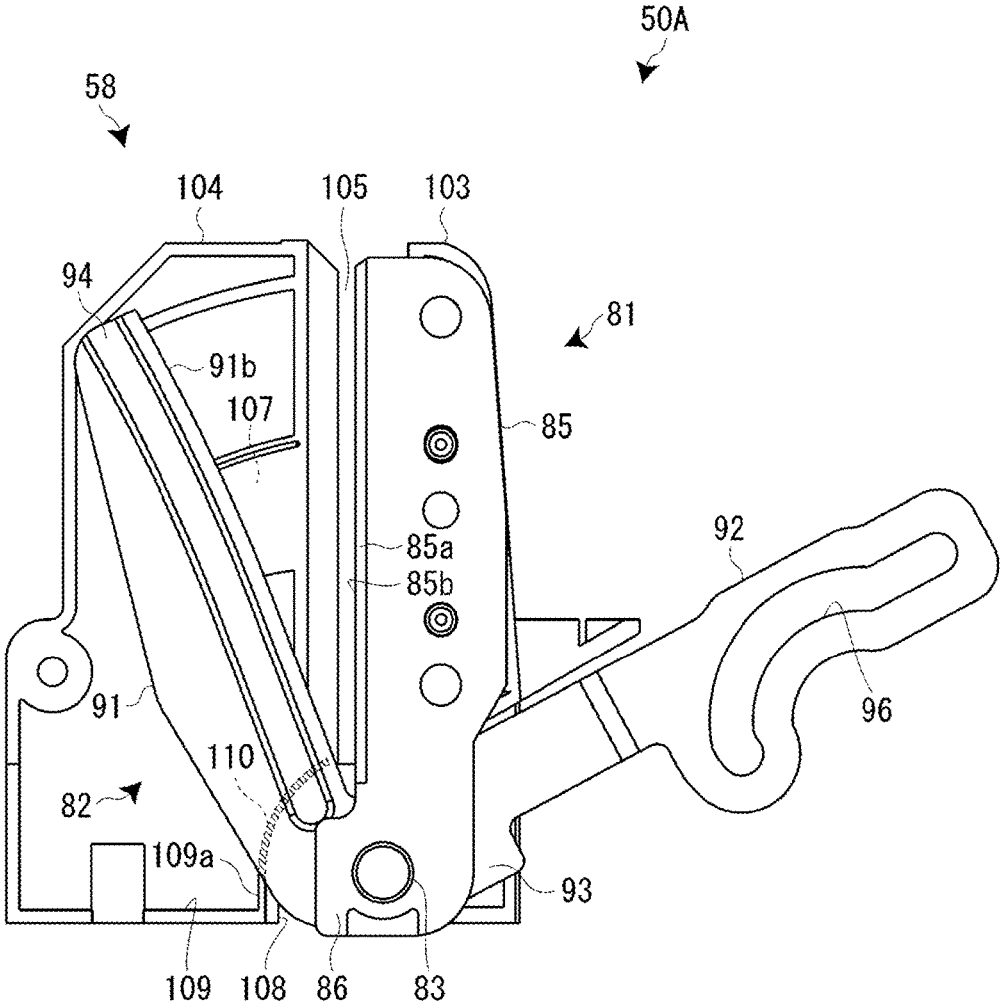
FIG. 8 is a plan view of the main part of the cutter unit according to the first embodiment.

A main part (a characteristic portion) of a full cutter 50A according to the first embodiment is explained with reference to FIGS. 7 and 8. As shown in the figures, in the full cutter 50A in the first embodiment, a pressing section 101 that presses the movable edge main body 91 to be tilted to the fixed edge main body 85 side is provided. Specifically, the pressing section 101 having a convex shape is provided in a part of the spacer frame 58 (a supporting frame) adjacent to the movable edge main body 91. The movable edge main body 91 is pressed by the pressing section 101 to be tilted in the opposite direction of the spacer frame 58.

The spacer frame 58 made of resin includes a fixed plate section 103 to which the fixed edge 81 is attached by the stepped screws 87, a partition plate section 104 that partitions the movable edge 82 and the cutting edge 71, and a slit section 105 provided to cut in from the upper side between the fixed plate section 103 and the partition plate section 104. The slit section 105 configures a route for feeding the printing tape T. The fixed edge 81 and the edge receiving member 72 of the half cutter 51 are disposed along the feeding route.

An arcuate groove 107 for avoiding the turning pin 77 of the half cutter 51 is formed in a vertical intermediate position of the partition plate section 104. On the lower side of the slit section 105, a hollow section 108 having a reverse "U" shape for avoiding the support shaft 83 is formed across the partition plate section 104 and the fixed plate section 103. On the other hand, on a surface on the full cutter 50A side of the partition plate section 104, a reinforcing rib 109 is integrally formed along the contour of the surface. That is, the partition plate section 104 and the reinforcing rib 109 are integrally formed.

The convex pressing section 101 is provided in apart of an arcuate rib section 109*a* corresponding to the hollow section 108 in the reinforcing rib 109. Specifically, the pressing section 101 is protrudingly provided in a portion opposed to the movable edge main body 91, that is, a portion opposed to the movable edge main body 91, which performs a cutting motion, in the arcuate rib section 109*a*. The arcuate rib section 109*a* and the pressing section 101 protrudingly provided in the arcuate rib section 109*a* toward the movable edge main body 91 are integrally formed. The pressing section 101 presses a base (the edge front side) of the movable edge main body 91.

In this case, the pressing section 101 is protrudingly provided in thickness same as the thickness of the arcuate rib section 109*a* and along the arcuate rib section 109*a*. A projecting dimension of the pressing section 101 from the arcuate rib section 109*a* is set to weakly press the movable edge main body 91, which performs the cutting motion, in a state in which slack does not occur in the support shaft 83 and strongly press the movable edge main body 91, which performs the cutting motion, in a state in which slack occurs in the support shaft 83. Note that the pressing section 101 may be inclined upward in a cutting-in direction of the movable edge main body 91 to apply "torsion (twisting)" to the movable edge main body 91.

In this way, in the full cutter 50A in the first embodiment, the movable edge main body 91 is pressed to tilt to the fixed edge main body 85 side by the pressing section 101 protrudingly provided in the arcuate rib section 109*a* of the spacer frame 58 (the partition plate section 104). Therefore, the movable edge main body 91 always slightly tilts to the fixed edge main body 85 side around the support shaft 83 in the cutting motion. That is, even if slack occurs in the support shaft 83, a contact state ("bowing (warping)") of the fixed edge main body 85 and the movable edge main body 91 is maintained. Therefore, it is possible to maintain original satisfactory sharpness for a long time.

Since the pressing section 101 is provided in the spacer frame 58, it is possible to easily form the pressing section 101 and dispose the pressing section 101 with high space efficiency. Therefore, a structure around the full cutter 50A is not complicated and is not increased in size.

Note that the pressing section 101 may be located on the upper side of the arcuate rib section 109*a* and separately provided in the partition plate section 104. The pressing section 101 in this case presses the intermediate portion of the movable edge main body 91. In addition to or instead of the configuration explained above, a partition wall may be provided between the fixed edge 81 and the cartridge mounting section 23. The pressing section 101 may be provided in the partition wall to press the fixed edge main body 85.

Modification of the First Embodiment

Figure 9:
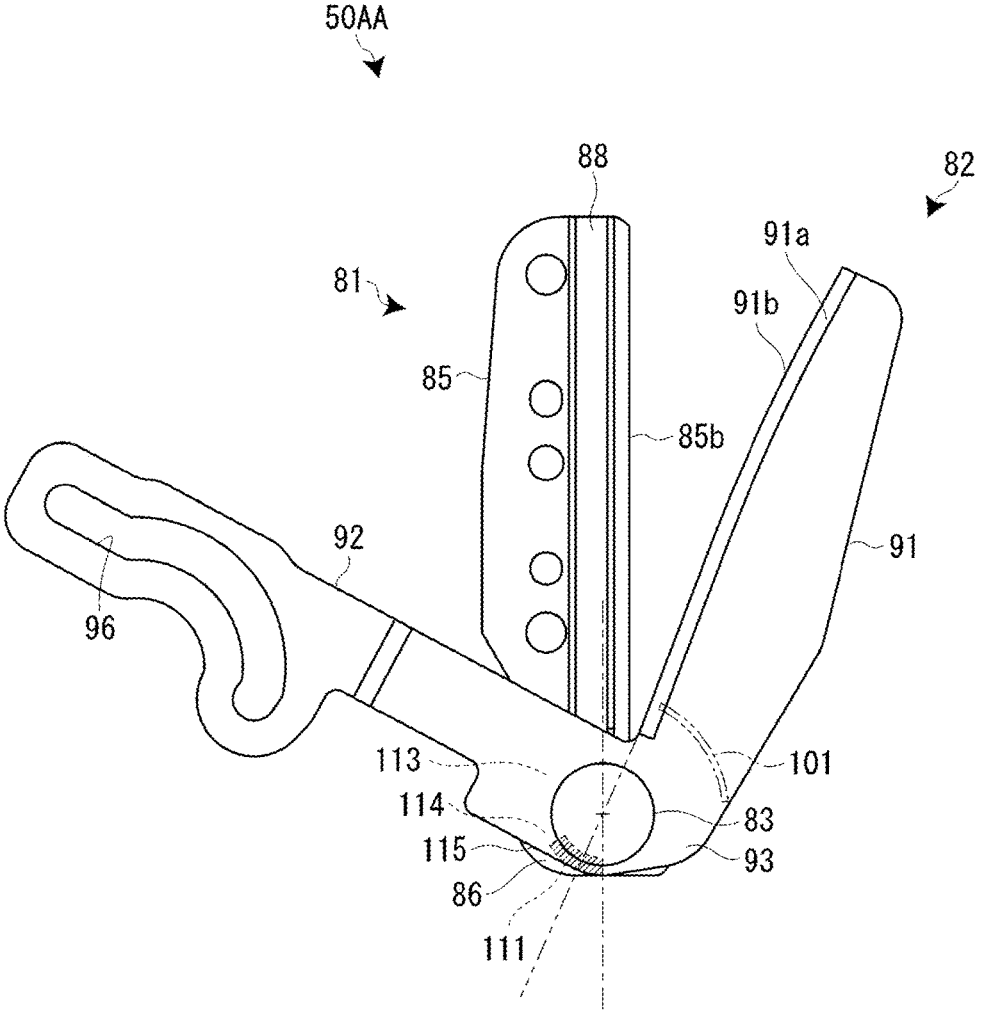
FIG. 9 is a plan view of a main part of a cutter unit according to a modification of the first embodiment.
Figure 10:
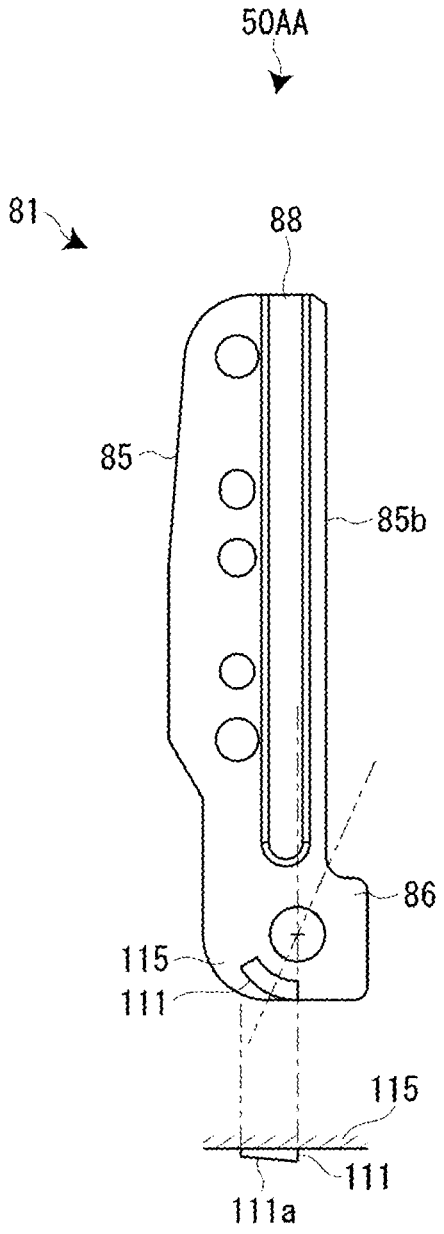
FIG. 10 is a plan view of the main part of the cutter unit according to the modification of the first embodiment.

A main part (a characteristic portion) of a full cutter 50AA according to a modification of the first embodiment is explained with reference to FIGS. 9 and 10. In this modification, differences from the first embodiment are mainly explained.

In the full cutter 50AA in the modification, a contact point section 111 that tilts the movable edge main body 91 to the fixed edge main body 85 side is provided in the axially supported section 86 located on the base side of the fixed edge 81.

Specifically, the contact point section 111 comes into contact with an extended upper part 114 present on extension of the edge tip 91*b* of the movable edge 82 across the support shaft 83 and is provided in an extended overlapping part 115 of the fixed edge 81 overlapping the extended upper part 114 in a shaft peripheral edge portion 113 on an edge back side of the movable edge 82 located around the support shaft 83. That is, in order to press the extended upper part 114 present on the extension of the edge tip 91*b* of the movable edge 82 across the support shaft 83 in the shaft peripheral edge portion 113 on the edge back side in the bent section 93 of the movable shaft 82, the contact point section 111 is protrudingly provided in the extended overlapping part 115 in the axially supported section 86 of the fixed edge 81 overlapping the extended upper part 114.

In this case, the contact point section 111 has an arcuate plane shape having a predetermined width centering on the support shaft 83. The contact point section 111 has an inclined surface 111*a* inclining upward in a turning direction of the cutting-in movable edge 82 (shaft peripheral edge portion 113). That is, warping equivalent to the "bowing (warping)" is applied and twisting equivalent to the "torsion (twisting)" is applied to the movable edge main body 91 by the contact point section 111 having the inclined surface 111*a*. Note that the inclined surface 111*a* of the contact point section 111 may be slightly inclined downward to the support shaft 83 in addition to the inclination explained above.

In this way, in the full cutter 50AA according to the modification of the first embodiment, the contact point section 111 is provided in the extended overlapping part 115 of the movable edge 82 (the bent section 93). The movable edge main body 91 is tilted and twisted to the fixed edge main body 85 side with the support shaft 83 as a fulcrum. Consequently, even if slack occurs in the support shaft 83, it is possible to surely maintain a contact state of the fixed edge main body 85 and the movable edge main body 91. Therefore, it is possible to maintain original satisfactory sharpness for a long time.

Note that the contact point section 111 may be provided in the movable edge 82 (the extended upper part 114) together with or instead of the fixed edge 81. In the full cutter 50, the contact point section 111 can be provided instead of the pressing section 101.

Figure 11:
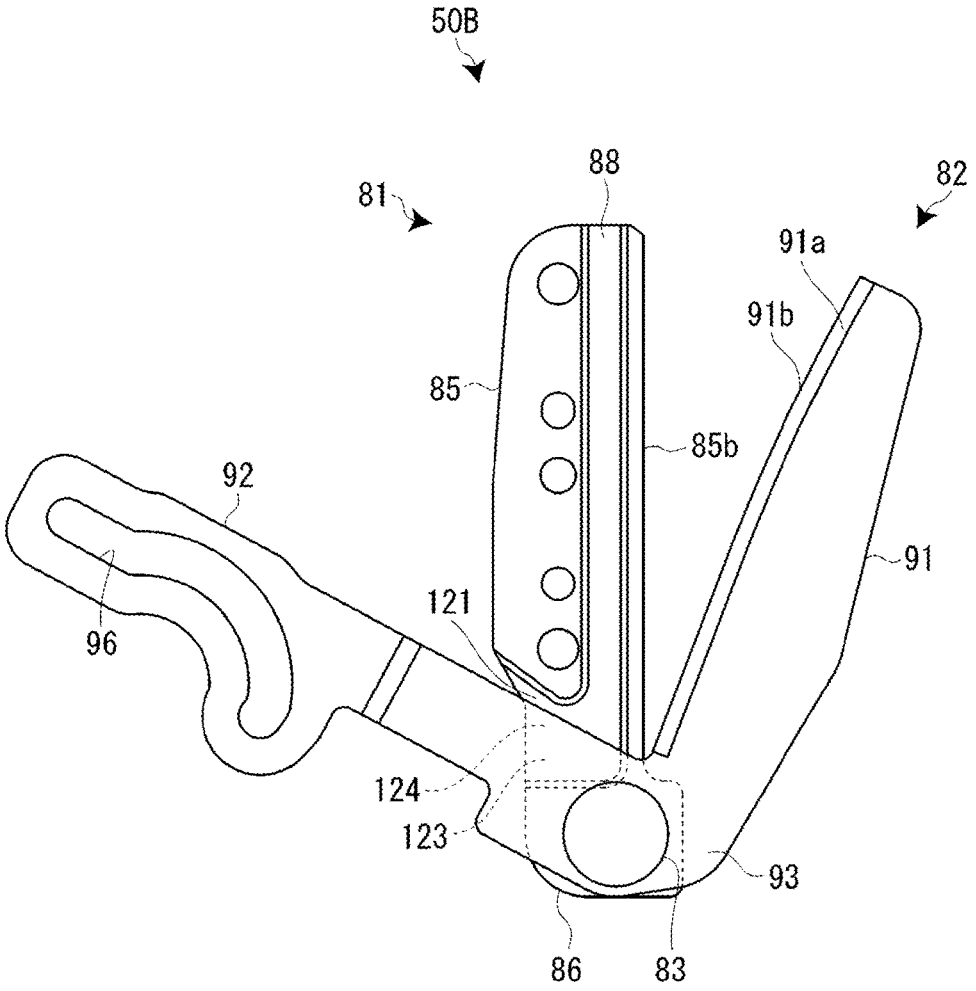
FIG. 11 is a plan view of a full cutter according to a second embodiment.
Figure 12:
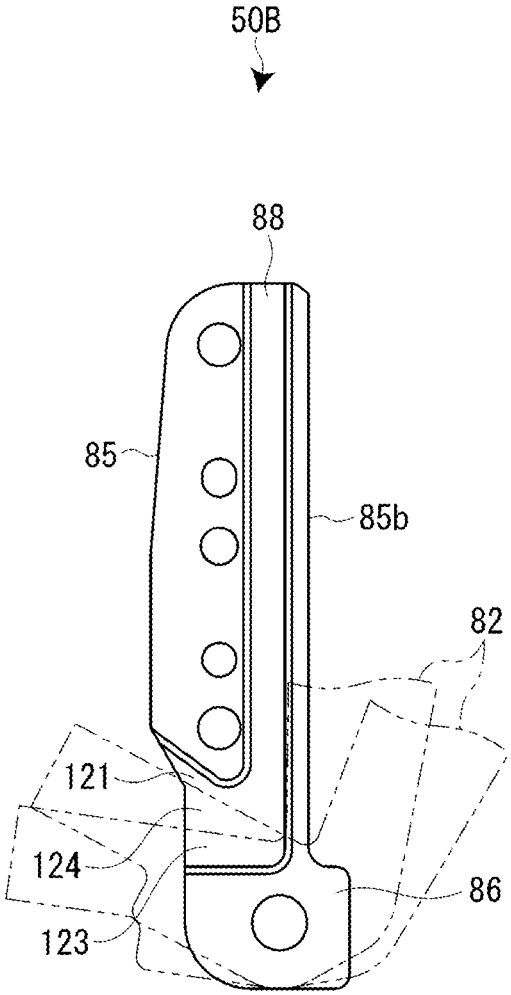
FIG. 12 is a plan view of the full cutter according to the second embodiment.

A main part (a characteristic portion) of a full cutter 50B according to a second embodiment is explained with reference to FIGS. 11 and 12. As shown in the figures, in the full cutter 50B in the second embodiment, a recessed section 121 is provided to range to the splitting section 88 on an edge back of the fixed edge 81. Specifically, the recessed section 121 is provided on the base side of the fixed edge 81 to form a gap between an edge part 123 of the actuation lever section 92 separated from the support shaft 83 in the extending direction of the fixed edge 81 and an overlapping part 124 of the fixed edge 81 overlapping the edge part 123.

As explained above, the splitting section 88 is recessed along an edge tip 81*b* on the edge back of the fixed edge 81. The recessed section 121 is formed to range to the base side of the splitting section 88 and at depth same as the depth of the splitting section 88. That is, with respect to the edge part 123 in the bent section 93 of the actuation lever section 92 separated from the support shaft 83 in the extending direction of the fixed edge main body 85, the overlapping part 124 of the fixed edge 81 overlapping the edge part 123 changes according to the movable edge 82 (the bent section 93 of the actuation lever section 92), which performs the cutting motion. Therefore, according to the changing overlapping part 124, the recessed section 121 is formed in a portion separated from the support shaft 83 and extending from the fixed edge main body 85 to the axially supported section 86.

In this way, in the full cutter 50B in the second embodiment, the recessed section 121 is formed on the edge back of the fixed edge 81 to range to the base side of the splitting section 88. Therefore, a gap is formed between the edge part 123 of the actuation lever section 92 and the overlapping part 124 of the fixed edge 81 overlapping the edge part 123.

Consequently, it is possible to suppress reaction due to contact of this portion in the cutting motion. Therefore, even if slack occurs in the support shaft 83, it is possible to prevent the movable edge main body 91 from easily separating from the fixed edge main body 85 around the support shaft 83. It is possible to maintain original satisfactory sharpness for a long time.

Note that the recessed section 121 may be recessed on the edge back of the movable edge 82 together with or instead of the edge back of the fixed edge 81.

Modification of the Second Embodiment

Figure 13:
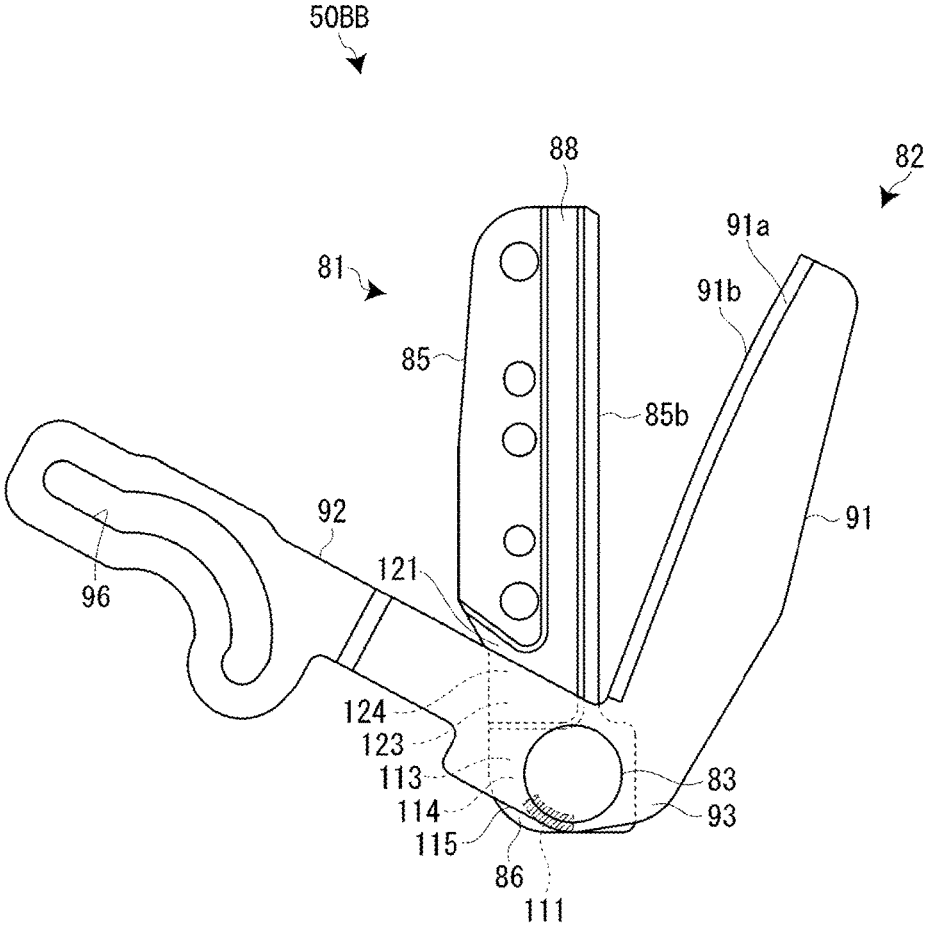
FIG. 13 is a plan view of a full cutter according to a modification of the second embodiment.
Figure 14:
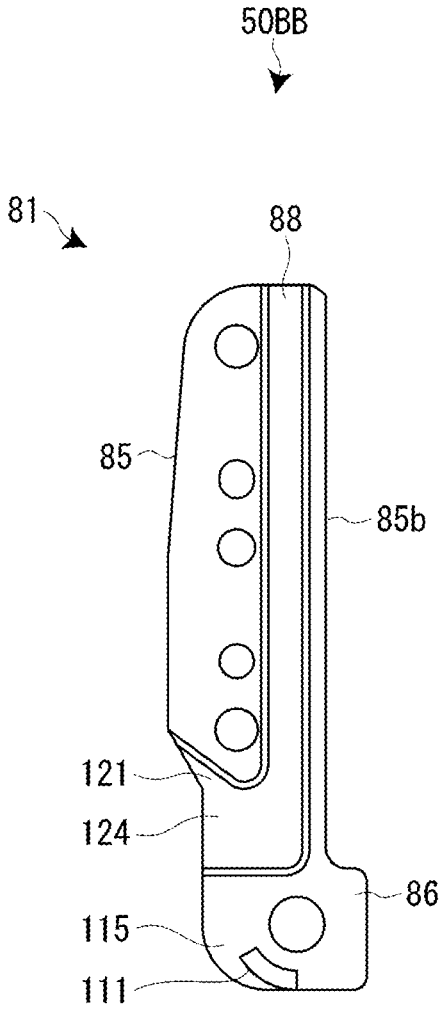
FIG. 14 is a plan view of the full cutter according to the modification of the second embodiment.

A main part (a characteristic portion) of a full cutter 50BB according to a modification of the second embodiment is explained with reference to FIGS. 13 and 14. The full cutter 50BB in this modification includes, in the main part of the full cutter 50BB, a form same as the form of the full cutter 50AA according to the modification of the first embodiment.

Specifically, in the full cutter 50BB in the modification, that contact point section 111 that tilts the movable edge main body 91 in a bowing direction is provided in the axially supported section 86 located on the base side of the fixed edge 81. The contact point section 111 comes into contact with the extended upper part 114 present on the extension of the edge tip 91*b* of the movable edge 82 across the support shaft 83 and is provided in the extended overlapping part 115 of the fixed edge 81 overlapping the extended upper part 114 in the shaft peripheral edge portion 113 on the edge back side of the movable edge 82 located around the support shaft 83. That is, the contact point section 111 is disposed in a position diagonal to the recessed section 121 across the support shaft 83. In this case, the contact point section 111 also has the inclined surface 111*a*.

In this way, also in the full cutter 50BB according to the modification of the second embodiment, the contact point section 111 is provided in the extended overlapping part 115 of the movable edge 82 (the bent section 93). The movable edge main body 91 is tilted and twisted to the fixed edge main body 85 side with the support shaft 83 as a fulcrum. Consequently, even if slack occurs in the support shaft 83, it is possible to surely maintain a contact state of the fixed edge main body 85 and the movable edge main body 91. Therefore, it is possible to maintain original satisfactory sharpness for a long time.

Also in this case, the movable edge 82 (the extended upper part 114) may be provided together with or instead of the fixed edge 81. In the full cutter 50, the contact point section 111 may be provided instead of the recessed section 121.

Note that the cutting device according to the invention is also applicable to a cutting device of a scissors type that cuts a printed sheet-like member and a cutting device of a scissors type that cuts an unprinted sheet-like member. That is, the printing device according to the invention is not limited to the tape printing apparatus 10.

This application claims priority under 35 U.S.C. § 119 to Japanese Patent Application No. 2016-064498, filed Mar. 28 2016. The entire disclosure of Japanese Patent Application No. 2016-064498 is hereby incorporated herein by reference.

What is claimed is:

1. A cutting device of a scissors type including a fixed edge, a movable edge, and a support shaft configured to support the fixed edge and the movable edge such that the movable edge is configured to rotate with respect to the fixed edge, the movable edge including a movable edge main body including a cut-off edge and an actuation lever section ranging to the movable edge main body and bending and extending to the fixed edge side in a portion of the support shaft, wherein at least one of an edge part of the actuation lever section separated from the support shaft in an extending direction of the fixed edge and an overlapping part of the fixed edge overlapping the edge part is formed in a concave shape to form a gap between the edge part and the overlapping part, and the gap between the edge part and the overlapping part extends to an outer periphery of the fixed edge in a direction that is perpendicular to the extending direction of the fixed edge.

2. The cutting device according to claim 1, wherein in an edge back of the fixed edge, a splitting section is recessed along an edge tip of the fixed edge, the overlapping part is formed in the concave shape, and the overlapping part is configured by a recessed section ranging to the splitting section.

3. A printing apparatus comprising:

a printing section configured to perform printing on a printing tape; and the cutting device according to claim 2 configured to cut off a printed portion of the printing tape.

4. The cutting device according to claim 2, comprising a contact point section interposed between an extended upper part present on extension of the edge tip of the movable edge across the support shaft and an extended overlapping part of the fixed edge overlapping the extended upper part in a shaft peripheral edge portion on an edge back side of the movable edge and configured to press the movable edge main body to tilt to the fixed edge side with the support shaft as a fulcrum.

5. The cutting device according to claim 4, wherein the contact point section is provided in the fixed edge and formed in an arcuate shape centering on the support shaft.

6. The cutting device according to claim 5, wherein the contact point section has an inclined surface inclining upward in a turning direction of the cutting-in movable edge. tape.

7. A printing apparatus comprising:

a printing section configured to perform printing on a printing tape; and the cutting device according to claim 6 configured to cut off a printed portion of the printing tape.

8. A printing apparatus comprising:

a printing section configured to perform printing on a printing tape; and the cutting device according to claim 4 configured to cut off a printed portion of the printing tape.

9. A printing apparatus comprising:

a printing section configured to perform printing on a printing tape; and the cutting device according to claim 5 configured to cut off a printed portion of the printing tape.

10. A printing apparatus comprising:

a printing section configured to perform printing on a printing tape; and the cutting device according to claim 1 configured to cut off a printed portion of the printing tape.

* * * * *